US011591824B2

(12) United States Patent
Jung et al.

(10) Patent No.: US 11,591,824 B2
(45) Date of Patent: Feb. 28, 2023

(54) DOOR LOCK

(71) Applicant: RITTAL GMBH & CO. KG, Herborn (DE)

(72) Inventors: Roman Jung, Duisburg (DE); Achim Bloh, Hohenahr (DE)

(73) Assignee: RITTAL GMBH & CO. KG, Herborn (DE)

( * ) Notice: Subject to any disclaimer, the term of this patent is extended or adjusted under 35 U.S.C. 154(b) by 199 days.

(21) Appl. No.: 16/755,196

(22) PCT Filed: Oct. 1, 2018

(86) PCT No.: PCT/DE2018/100821

§ 371 (c)(1),
(2) Date: Apr. 10, 2020

(87) PCT Pub. No.: WO2019/076397

PCT Pub. Date: Apr. 25, 2019

(65) Prior Publication Data

US 2021/0189768 A1 Jun. 24, 2021

(30) Foreign Application Priority Data

Oct. 20, 2017 (DE) ..... 10 2017 124 605.3

(51) Int. Cl.
*E05B 63/00* (2006.01)
*E05C 3/04* (2006.01)
*E05B 9/08* (2006.01)

(52) U.S. Cl.
CPC ..... *E05B 63/006* (2013.01); *E05C 3/042* (2013.01); *E05B 9/08* (2013.01)

(58) Field of Classification Search
CPC ..... Y10T 292/57; Y10T 292/1043; Y10T 292/108; Y10T 70/7678; Y10T 70/8838; E05B 63/006; E05B 9/08; E05B 15/0046; E05C 3/042; E05C 19/00; E05C 19/005; Y10S 292/06; Y10S 292/20; Y10S 292/38
See application file for complete search history.

(56) References Cited

U.S. PATENT DOCUMENTS 2,281,443 A * 4/1942 Jones ..... F16B 5/10 411/550
2,491,783 A 12/1949 Thomas
(Continued)

FOREIGN PATENT DOCUMENTS

BE 893293 A2 * 9/1982 ..... E05B 15/02
CA 2421457 A1 * 9/2004 ..... E05C 19/182
(Continued)

OTHER PUBLICATIONS

International Search Report (in English and German) and Written Opinion of the ISA (in German) issued in PCT/DE2018/100821, dated Nov. 23, 2018; ISA/EP.

*Primary Examiner* — Kristina R Fulton
*Assistant Examiner* — Steven A Tullia
(74) *Attorney, Agent, or Firm* — Harness, Dickey & Pierce, P.L.C.

(57) ABSTRACT

The invention relates to a door lock with a locking element (1) for locking the door (3) in a closed state and a fastening element (2) for fastening the locking element (1) to the door (3), wherein that the fastening element (2) has an adjustable adjustment device (4) to compensate for different door thicknesses.

16 Claims, 3 Drawing Sheets

(56) References Cited

Figure 1A:
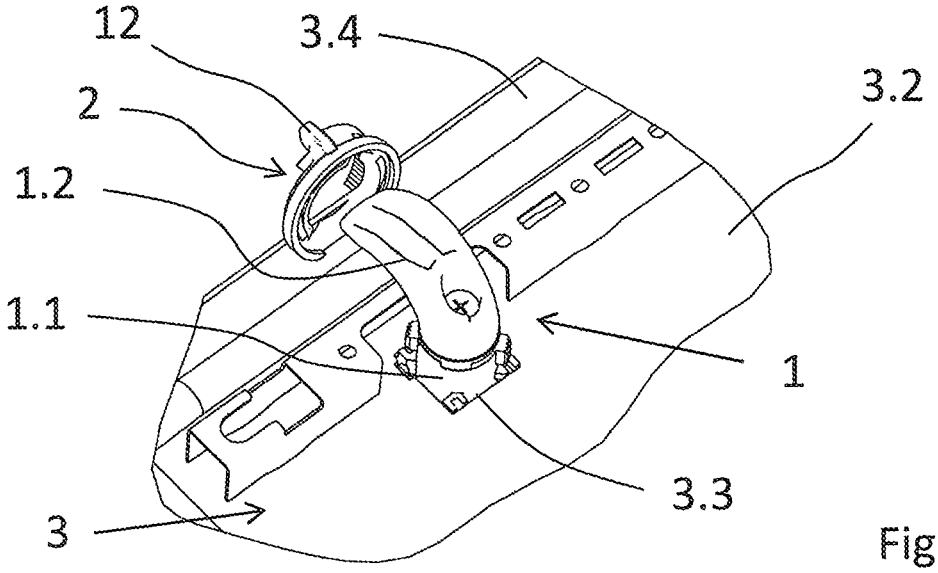

U.S. PATENT DOCUMENTS 2,673,112 A * 3/1954 Andrews ..... E05C 19/182 292/296
2,759,754 A 8/1956 Kaiser
2,837,362 A * 6/1958 Meyer ..... B60J 1/14 292/207
2,981,560 A * 4/1961 Alfred ..... E05B 13/002 292/207
3,858,740 A * 1/1975 Lestaevel ..... B65D 55/12 215/331
4,427,124 A * 1/1984 Marshall ..... B65D 50/046 215/209
4,573,334 A * 3/1986 Crepinsek ..... E05B 63/006 70/451
4,647,093 A * 3/1987 Palsson ..... E05B 63/244 292/251
4,688,835 A * 8/1987 Wu ..... E05C 3/042 292/59
4,911,489 A * 3/1990 Hansen ..... E05B 15/04 292/DIG. 60
4,976,480 A * 12/1990 Dixon ..... E05B 55/005 292/353
4,986,585 A * 1/1991 Panter ..... E05B 13/001 292/346
5,152,161 A * 10/1992 Lee ..... E05B 63/0013 292/64
5,193,867 A * 3/1993 Husted ..... E05B 35/008 70/451
5,413,392 A * 5/1995 Schlack ..... E05B 35/008 70/451
5,533,368 A * 7/1996 Eagan ..... E05B 63/006 70/374
5,678,437 A 10/1997 Walla
6,131,970 A * 10/2000 Hurst ..... E05B 3/06 292/336.3
6,223,572 B1 5/2001 Marttinen
6,357,268 B1 * 3/2002 Takimoto ..... E05B 17/0025 70/210
6,357,958 B1 * 3/2002 Geib ..... F16B 2/065 403/379.6
6,508,092 B1 * 1/2003 Laabs ..... E05B 9/084 248/222.12
7,340,928 B2 * 3/2008 Hoffman ..... E05B 9/084 70/451
8,967,681 B2 * 3/2015 Masumoto ..... E05C 3/145 292/194
9,714,527 B2 7/2017 Winkler
2005/0115288 A1 * 6/2005 Burmahln ..... E05C 3/042 70/127
2010/0259053 A1 * 10/2010 Cramer ..... E05B 3/06 292/354
2012/0019013 A1 * 1/2012 Bunker, II ..... E05C 1/16 292/336.3
2015/0167353 A1 6/2015 Winkler
2017/0254118 A1 9/2017 Winkler
2019/0257125 A1 8/2019 Bloh et al.
2019/0323273 A1 10/2019 Georg et al.

FOREIGN PATENT DOCUMENTS

CH 585837 A5 * 3/1977 ..... E05B 3/08
DE 4009752 A1 * 10/1991 ..... E05C 3/042
DE 20113035 U1 * 10/2001 ..... E05B 1/0092
DE 20314117 U1 * 1/2004 ..... E05B 15/02
DE 202004003707 U1 7/2005
DE 202004003707 U1 * 9/2005 ..... E05B 17/0025
DE 202010004366 U1 * 6/2010 ..... E05B 17/002
DE 202012103460 U1 * 12/2013 ..... E05B 13/005
DE 202016007457 U1 * 12/2016 ..... A01K 27/005
EP 0258491 A1 * 3/1988 ..... E05B 9/084
FR 1376584 A * 10/1964 ..... E05B 9/08
FR 2379676 A1 * 9/1978 ..... E05B 3/10
FR 2944044 A1 * 10/2010 ..... E05C 3/042
GB 922303 A * 3/1963 ..... E05C 3/042
GB 2246808 A 2/1992
WO WO-2013182278 A1 12/2013
WO 2015004278 A1 1/2015
WO WO-2015004278 A1 * 1/2015 ..... A01K 27/005

* cited by examiner

DOOR LOCK

The invention relates to a door lock with a locking element for locking the door in a closed state and an fastening element for fastening the locking element to the door. Furthermore, the invention relates to a corresponding door and a method for fastening a locking element to a door.

Such doors usually comprise locking elements, which serve to lock the door in a closed position so that it cannot be opened. For locking the door, the locking elements usually interact with a fixed frame of the door in a form-fitting manner. For example, locking elements are known which can hook into a door frame or undercut it, such as is the case for instance with cam locks. To reopen a closed and locked door, the locking element must first be moved from its locked position to an unlocked position in which the locking element no longer interacts with the frame of the door and the door can thus be opened.

In order to attach a locking element to a door, the door usually has an opening through which the locking element can be inserted. On the outside of the door, for example, a handle or an interface for interaction with a key or a tool can then be arranged to transfer the locking element from the locked position to the unlocked position or vice versa. On the inside of the door, the locking element may have, for example, a hook, a cam or a locking bar, depending on the requirements.

For fastening the locking element to the door, it is known to use a fastening element on the inside of the door which is not accessible and not visible from the outside. Such a fastening element serves to create a connection between the door and the locking element so that the door cannot be opened when the locking element is in the locked position.

Due to the fact that the described locking elements must pass through the door, the design of corresponding door locks is disadvantageously dependent on different door thicknesses, or different door locks can only be used for a limited range of different door thicknesses respectively. For example, when the door is too thick, the fastening element on the inside of the door may cause damage or unappealing scratches or, in the worst case, the door latch cannot be mounted on the door at all. On the other hand, when the door is too thin, the locking element may not be able to be securely fastened to the door, in which case reliable locking of the door is jeopardized. In view of this, the invention has the objective of specifying a door lock that can be used variably.

This objective is solved for a door lock of the above-mentioned type by the features of claim 1, according to which the fastening element has an adjustable adjustment device to compensate for different door thicknesses.

Thanks to the adaptable adjustment device, one and the same door lock can be used for doors of different thicknesses. It is not necessary to adjust the locking element and/or the fastening element to the thickness of the door in advance or to select a specific locking element and/or fastening element depending on the thickness of the door. The locking element can be variably fixed to doors of different thicknesses. There is no risk of damage to the door or of the locking element not being securely fastened to the door.

From a design point of view, it has proven to be advantageous when the fastening element is part of a bayonet fastening. With a bayonet fastening, a simple and quick assembly can be realized for which no additional tools are required. Furthermore, a bayonet fastening also enables very simple and quick disassembly. It is possible that the fastening element is designed as a bayonet ring. The bayonet ring can be connected to a second part of a bayonet fastening by rotation. The locking element can also be part of a bayonet fastening, so that the locking element and the fastening element can interact like a bayonet lock. It is possible that the two elements can be easily connected or disconnected by a rotation relative to each other.

The fastening element can rest on one side of the door, particularly the inside, in the fastening position, i.e. when fastening the locking element to the door. For this purpose, the fastening element may have a bearing area for bearing on the door. The fastening element may be connectable to the inside of the door. Preferably the fastening element is frictionally connected to the door in the fastening position.

To connect the fastening element to the door, it has proved advantageous when the fastening element is pressable onto the door via the adjustment device. By such a pressing, a frictional connection between fastening element and door can be created. Furthermore, such a connection offers the advantage that it is particularly suitable for quick assembly or quick disassembly. The adjustment device can be configured such that the fastening element is pressable or pressed onto the door via the adjustment device.

Regarding the contact pressure of the fastening element on the door, it has proved to be advantageous when the contact pressure is adjustable via the adjustment device. By adjusting the contact pressure, damage to the door can be avoided. Furthermore, a too loose connection of the fastening element to the door can also be avoided.

In an advantageous embodiment, the contact pressure can be adjusted by rotating the fastening element relative to the locking element. The contact pressure can be easily adjusted by a rotary movement and the door lock can be fastened to the door. Regarding the locking element, it has proved to be advantageous when it has a bearing area, for example in the form of a rosette, in the area of the outside of the door. This bearing area can fix the locking element in a direction relative to the door. The locking element can only be inserted through the door up to a specific point. The fastening element can clamp the locking element onto the door. The bearing area can be pressed against the door from the outside and the fastening element can be pressed against the door from the inside. A frictional connection can be formed between the locking element and the door and between the fastening element and the door.

Furthermore, it has proved to be advantageous when the locking element moves in the axial direction relative to the fastening element when the fastening element is rotated. The locking element can move relative to the door when the fastening element is rotated and the fastening element can move relative to the locking element. The movement of the elements when assembling can be the cause of the contact pressure acting in the fastening position. In this way, the contact pressure can be adjusted depending on the movement of the elements relative to each other.

Regarding the arrangement of the locking element and the fastening element, it has proved to be advantageous when the locking element is guided axially in the fastening element. Axial guidance allows easy assembly. For example, the fastening element can be put over the locking element. The fastening element can be of annular shape and have an annular base body. The locking element can be arranged concentrically to the fastening element.

In accordance with a constructive design, it is proposed that the locking element has a bearing element and the fastening element interacts with the bearing element. The bearing element may extend through the door and be coupled to the bearing area on the outside of the door. The bearing element can be designed, for example, as a bushing, a plain bearing or a roller bearing. A shaft can be rotatably mounted in the bearing element. The shaft can be connected to an actuating element, in particular a handle, a pawl, a pivoted lever or the like, to actuate the locking element. The actuating element may be located on the outside of the door.

Furthermore, in an advantageous embodiment the locking element can have a locking tongue. The locking tongue can be rotated back and forth about a locking rotation axis between a locked position and an unlocked position, whereby the door can be locked and not be moveable, in particular not openable, in the locked position. The locking tongue can be rotatable relative to the bearing element and can be connected to the shaft rotatably mounted in the bearing element, so that the locking tongue can be actuated via the actuating element. In the locked position, the locking tongue can interact with the frame of the door so that the door is locked and cannot be opened. It is advantageous when the locking tongue is designed as a cam. However, embodiments are also possible in which the locking tongue is formed as a locking rod, locking hook or the like.

Furthermore, it has proved to be advantageous from a design point of view when the locking element has at least one latching element to interact with the fastening element. The latching element can interact with the fastening element in the manner of a bayonet connection. The latching element can be arranged on the bearing element so that a rotational movement of the bearing element relative to the fastening element is prevented in the fastening position. The latching element can be positively connected to the fastening element in the fastening position. The latching element can be guided in or on the fastening element. Furthermore, it is also possible that several latching elements, particularly two latching elements, are provided.

From a design point of view, it has proved to be advantageous when the latching element is formed as a radial projection. The latching element can extend in the radial direction in the manner of a latch nose and thus interact with the fastening element in a simple constructive way.

The fastening element can be formed so that it presses the latching element and the door apart from each other. In this way, the bearing area and the fastening element are pressed against the door in the fastening position. This results in a frictional connection. The fastening element can be arranged between the latching element and the door in the manner of a clamp and can press the two elements apart so that the desired contact pressure is exerted on the door.

It is also advantageous when the fastening element can be moved back and forth in relation to the locking element between an assembly position and a fastening spot, whereby the contact pressure can be fixed in the fastening position. In the assembly position, the elements can be arranged in a force-free manner relative to each other, and by a rotary movement of the fastening element, the contact pressure can then be continuously raised, so that the door lock can be securely connected to the door. In the fastening position, the desired contact pressure can be achieved so that the door latch is securely connected to the door.

Furthermore, it has proved to be advantageous when the adjustment device has at least one ramp section which interacts with the latching element of the locking element when the fastening element is rotated from the assembly position to the latching position. The ramp portion allows the latching element to be moved axially away from the door when the fastening element is rotated so that the contact pressure increases. The latching element can slide on the ramp section when the fastening element is rotated. The degree of slope of the ramp section is the cause of the transmission ratio between rotation of the fastening element and change of contact pressure on the door. The ramp section can extend in the direction of a circular arc. Furthermore, several ramp sections can be provided. It is advantageous when the number of ramp sections corresponds to the number of latching elements. It is particularly advantageous when two latching elements and two ramp sections are provided on opposite sides.

It has also proved to be advantageous when the locking element has at least one recess which can be aligned with the latching element. In the assembly position, the recess can be aligned with the latching element so that the fastening element can be put over the locking element or the bearing element. When the fastening element is then turned, the latching elements slide along the ramp sections and the contact pressure can be adjusted. The recesses and the ramp sections can be arranged next to each other in a circular direction. The recess can be part of the bayonet lock. The number, size and arrangement of the recesses can be adapted to the latching elements.

Furthermore, it has proved to be advantageous when the adjustment device has a latching section for fixing the fastening element to the bearing element. The latching section may extend above or below the ramp section and may, for example, extend from the recess. The latching section can be configured as a latching tab.

Regarding the latching section, it has proved to be advantageous when the section has several latching steps. Each latching step can be assigned a specific contact pressure. The latching section can have several teeth which can interact with the latching element. The teeth can define different latching steps. The latching section and the latching element can interact with each other in a positive-locking manner, for example in the manner of a ratchet. The rotation of the fastening element can be prevented by the interaction of the latching element and latching section in one direction. During assembly, the fastening element can only be rotated in one direction. The latching element may have teeth corresponding to the teeth of the latching section. By turning the fastening element, one latching step after the other can be passed through and the contact pressure can be successively increased until the desired contact pressure is reached. Rotating back is no longer possible due to a positive connection of the teeth. In this position the fastening position is reached and the door latch is securely connected to the door.

Regarding the design of the teeth, it has proved to be advantageous when they are formed in the manner of saw teeth. This enables self-locking, so that the fastening element can only be turned in one direction and can pass through various latching steps. The teeth can have a sawtooth-like cross-section and, due to the interaction of the respective steeper sawtooth flanks, can prevent the fastening element from moving in one direction.

It is also advantageous when the latching section is pre-loaded in the radial direction in such a way that the teeth can engage independently in the corresponding latching areas of the locking element. This can result in reliable self-locking, so that the fastening element can only be rotated in one direction and any rotation in the opposite direction is prevented by the interaction of the latching section with the latching areas. The latching section can be pre-loaded in the direction of the centre axis of the actuating element.

Furthermore, it has proved to be advantageous when the latching section has a handling section over which the latching section can be moved in a radial direction against the pre-load direction so that the latching section and the latching area are disengaged and the fastening element can be rotated against the latching direction. This force, which is opposite to the pre-load force, must be applied in order to disassemble the fastening element. When the teeth of the latching area and those of the locking element are disengaged, the fastening element can be rotated freely relative to the locking element. When the fastening element is rotated to the position where the recess is aligned with the latching element, the fastening element can be removed from the locking element and the door latch can be disassembled.

It is also advantageous when the fastening element has an actuation area via which it can be rotated. An actuation area enables a simple application of force to the fastening element, for example to rotate it manually. The actuation area can be formed as a radial projection. It is also possible for the fastening element to have more than one actuation area, which allows a symmetrical application of force.

For a door with a predetermined door thickness, the problems described previously arise. Based on this, a door with a locking device is proposed which is configured in the manner described above. The advantages described with regard to the locking device result.

Furthermore, with regard to the task mentioned above, a method is proposed for fastening a locking element to a door with a fastening element, whereby the contact pressure of the fastening element on the door is adjusted by means of an adjustment device to compensate for different door thicknesses. It is advantageous when the locking element and the fastening element are part of a locking device and in particular when the locking device is designed in the manner described above. This results in the advantages already explained with regard to the locking device.

Figure 1B:
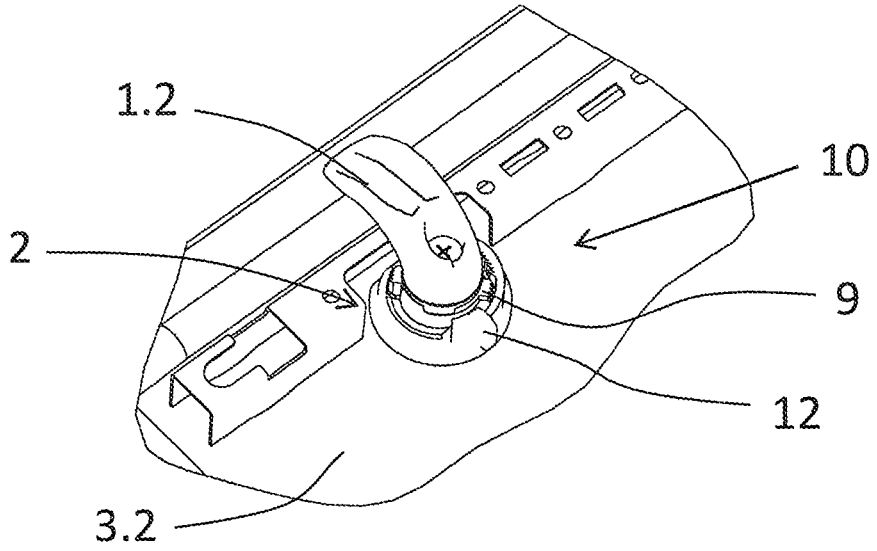
Figure 1C:
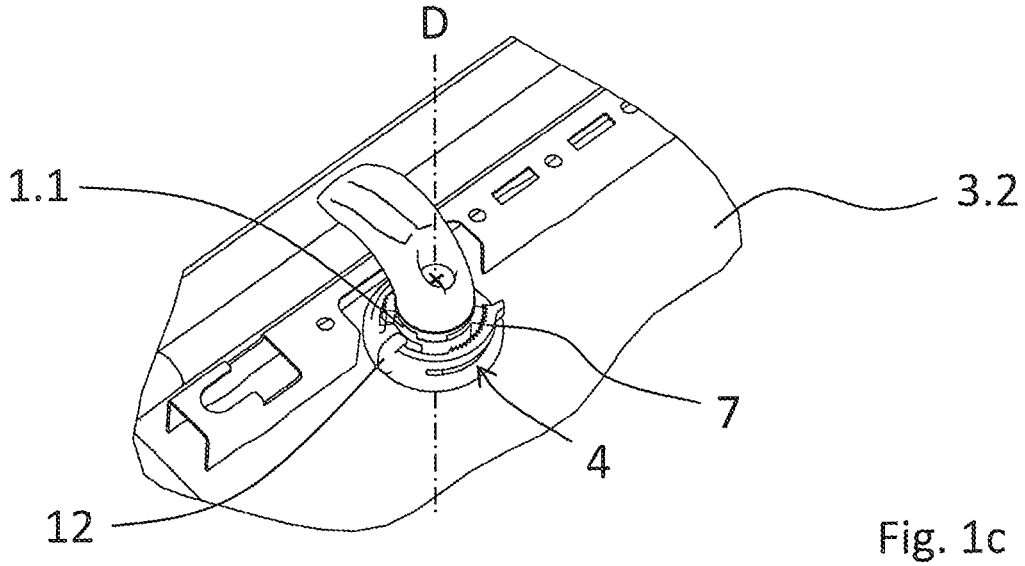
Figure 2A:
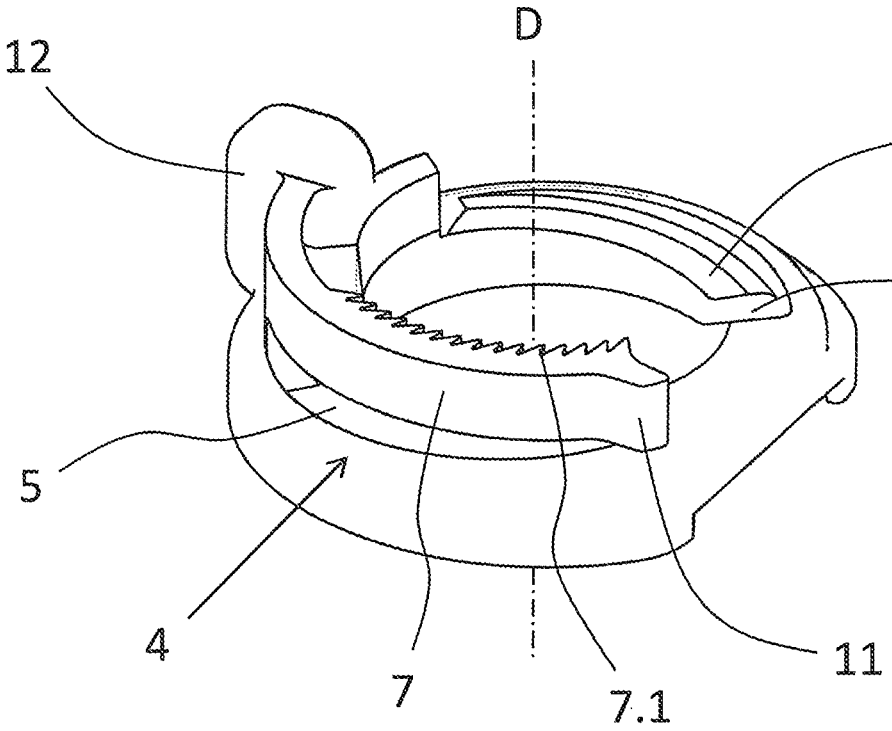
Figure 3:
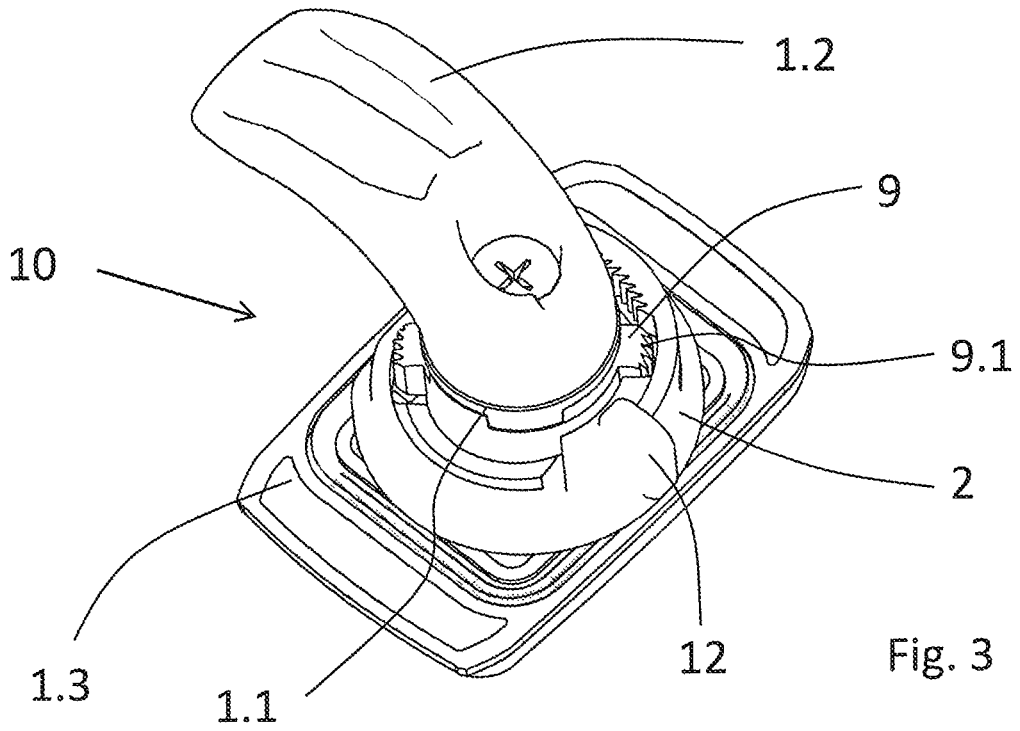
Figure 4:
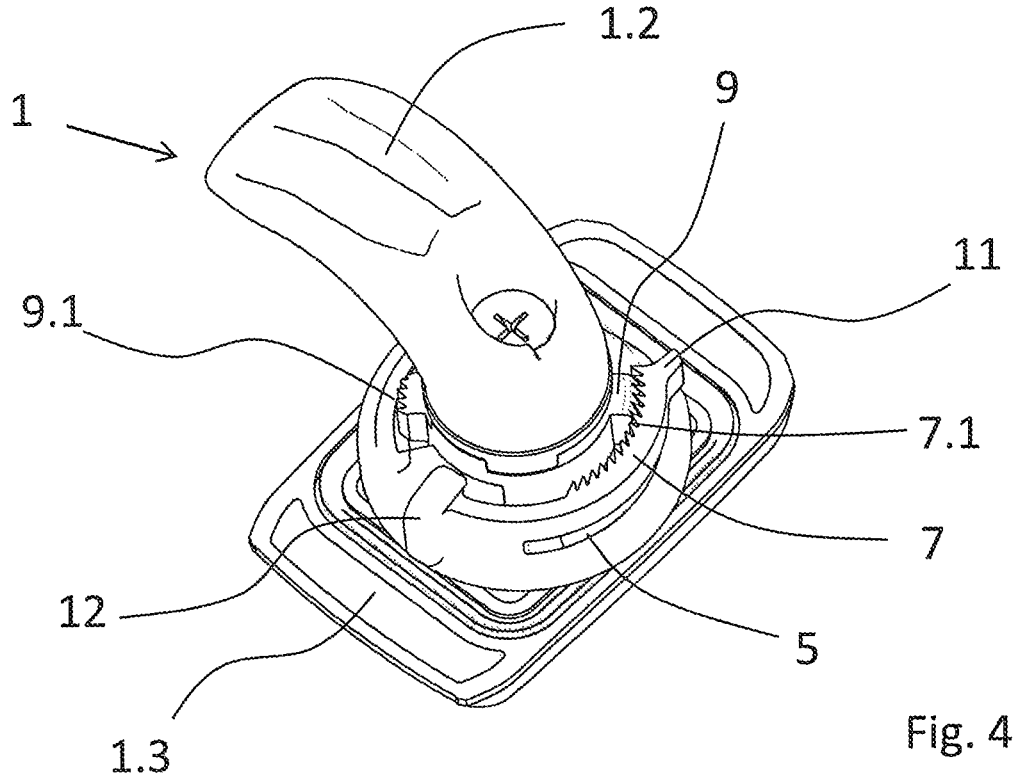

Further advantageous designs are explained in more detail below with help of FIG. 1 to 4. These show:

FIG. 1*a* to 1*c* Views of an assembly sequence for fastening a locking element with a fastening element to a door in three different positions;

FIG. 2*a, b* a perspective view and a top view of a fastening element;

FIG. 3 a perspective view of a door lock in the assembly position;

FIG. 4 a perspective view of the door lock according to FIG. 3 in the fastening position.

Door locks 10 usually consist of a locking element 1 with which a door 3 can be secured against undesired opening and a fastening element 2 with which the locking element 1 can be attached to the door 3.

For the purposes of this invention, the term "door" is generally understood to mean closing elements which can be moved back and forth between an open position and a closed position. In addition to normal swing or sliding doors, flaps, hatches, lids, windows and the like are therefore also covered by this term.

As will be explained in more detail below, door locks are subject to problems during assembly when the door locks are not adapted to the thickness of door 3. In the following, this will be briefly explained on the basis of the assembly steps shown in FIGS. 1*a* to 1*c*, before the inventive embodiment of door lock 10 will be discussed.

For the assembly of locking element 1, door 3 has an opening 3.3, through which locking element 1 can be inserted from the outside of door 3, as shown in the illustration in FIG. 1*a*. Locking element 1 has a bearing area in the form of a rosette 1.3 not shown in FIGS. 1*a* to 1*c*, which in the inserted position rests on the outside of door 3. This rosette 1.3 can be seen in FIGS. 3 and 4, in which the door 3 in front of rosette 1.3 is hidden for purposes of illustration. Rosette 1.3 is used to fix the locking element 1 in one direction so that it cannot be moved further towards the inside. Furthermore, locking element 1 has a locking tongue 1.2, which is formed as a cam in the exemplary embodiment. Locking tongue 1.2 can be swivelled about the axis of rotation D by means of a handle located on the outside of door 3.1 which is not shown in the figures. In the locked position, when door 3 is closed, locking tongue 1.2 engages behind the frame of door 3.4 so that door 3 is secured against unintentional opening. In order to open door 3 again, locking tongue 1.2 must be rotated about the axis of rotation D from the locked position back to the unlocked position, in which locking tongue 1.2 can be moved past frame 3.4 when door 3 is opened. Furthermore, the locking element 1 has a bearing element 1.1 formed as a bushing, which extends through the opening 3.3 of door 3 as shown in FIG. 1*a* and in which the locking tongue 1.2 is pivotally mounted.

In order to now connect locking element 1 to door 3 in the position according to 1*a* and secure it against being pulled out, the fastening element 2 is put over locking element 1 until it rests on the inside of door 3.2, as shown in FIG. 1*b*.

Figure 2B:
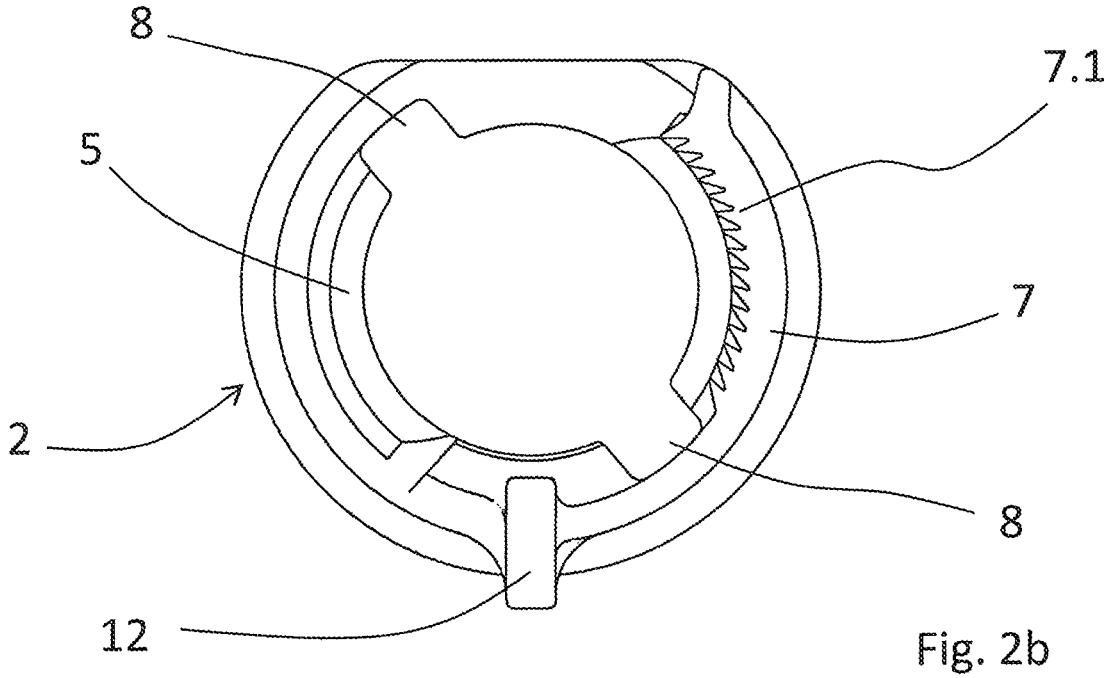

The bearing element 1.1 of locking element 1 has radially extending projections in the form of latching elements 9 on two opposite sides and the fastening element 2 has two correspondingly shaped and mutually opposing recesses 8, which can be best seen in FIG. 2*b*. To assemble the fastening element 2, it is arranged in such a way that the latching elements 9 are aligned with the recesses 8 and the fastening element 2 can be pushed forward via the latching elements 9 to the inside of the door 3.2, as can also be seen in the other FIGS. 1*b* and 1*c*.

There is a certain distance between the latching element 9 and the inside of the door 3.2, so that there is enough space remaining to rotate the fastening element 2. For better handling, the fastening element 2 has a radially projecting actuation area 12. The locking element 1 and the fastening element 2 interact in the manner of a bayonet lock, so that the recesses 8 no longer align with the latching elements 9 after a rotation of the fastening element, but undercut the fastening element 2. Since the fastening element 2 has a larger cross-section than the opening, the locking element 1 is secured against being pulled out.

However, for the fastening element 2 shown in FIGS. 1*a* to 1*c*, the problem arises that the space between the latching element 9 and the inside of door 3.2 is dependent on the thickness of door 3. When, for example, the door 3 is too thick, the locking element 1 and therefore also the latching elements 9 do not protrude far enough beyond the inside of the door 3.2, so that there is not enough space between the inside of the door 3.2 and the latching elements 9 for the fastening element 2. In this case, it can happen that the fastening element 2 has to be clamped with a lot of force between the door 3 and the latching element 9, which can easily lead to scratches on the door 3 or that it is not possible to assemble the locking element 1 with the fastening element 2. On the other hand, when the door 3 is too thin there is a certain gap between the door 3 and the fastening element 2 and also between the locking element 9 and the fastening element 2.

The fastening element 2 shown in the figures has an adjustment device 4 for this purpose, which can be best seen in FIG. 2*a* and which allows adaptation to different door thicknesses by means of different latching steps. In the following, the embodiment of fastening element 2 and adjustment device 4 will be described in more detail using FIGS. 2 to 4.

The adjustment device 4 has two ramp sections 5 extending in the direction of a circular arc, which, when the fastening element 2 is rotated around the locking element 1, lead to a continuous increase in the contact pressure acting on the door 3. The latching elements 9 move along the ramp sections 5 when the fastening element 2 is rotated, so that the distance of the latching elements 9 from the door 3 increases when rotating. This causes the fastening element 2 to be pressed from the inside of the door 3 and the rosette 3.1 from the outside of the door 3 onto the door 3, so that a frictional connection is created between the elements.

In addition, the adjustment device 4 has a latching section 7, which ensures that the fastening element 2 cannot loosen itself again on its own. During assembly, the fastening element 2 is first rotated until the desired contact pressure is applied to the door 3 and the locking element 1 is securely fastened to the door 3. In this fastening position, which is shown in FIG. 4, the fastening element 2 is fixed, which is explained in more detail below.

In order to prevent fastening element 2 from coming loose on its own in the fastening position, both the latching section 7 and one of the two latching elements 9 shown in the figures have correspondingly shaped teeth 7.1, 9.1. By means of teeth 7.1, 9.1 the fastening element 2 can thus be fixed in various latching positions relative to the closing element. As can also be seen, teeth 7.1, 9.1 have a sawtooth-like cross-section which ensures that a rotary movement of fastening element 2 is only possible in one direction. When the fastening element 2 rotates clockwise, the teeth 9.1 of the latching element 9 engage successively in the teeth 7.1 of the latching section 7, so that different latching positions are made possible. An opposite rotation is not possible due to the interaction of teeth 7.1, 9.1.

For the teeth 7.1 of the latching section 7 to be able to interact on their own with the teeth 9.1 of the latching element 9, the latching section 7 is arranged, or pre-loaded respectively, in such a way that the teeth 7.1 engage with the teeth 9.1 on their own, so that self-locking occurs.

In order to release door latch 10 from door 3, the fastening element 2 must be removed from the locking element 1, for which purpose teeth 7.1, 9.1 must first be disengaged. To release the tooth connection, a radial force directed against the pre-load force can be applied to the latching section 7 via the handle 11 formed as a nose, so that the teeth 7.1 of the latching section 7 and the teeth 9.1 of the latching element 9 are disengaged. In this position, the fastening element 2 can then be rotated counterclockwise relative to the locking element 1 until the latching elements 9 are again aligned with the recesses 8. In this position the fastening element 2 can be released from the locking element 1 and the locking element 1 can then be removed from the door 3.

Through the interaction of the latching element 9 with the ramp section 5 as well as with the latching section 7, the fastening element 2 can be adapted to different door thicknesses by a rotation. The distance between the latching element 9 and the inside of door 3.2 can be compensated, resulting in a variable and secure fastening of locking element 1 to door 3.

LIST OF REFERENCE NUMERALS

1 locking element
1.1 bearing element
1.2 latching tongue
1.3 rosette
2 fastening element
3 door
3.2 door inside
3.3 opening
3.4 frame
4 adjustment device
5 ramp section
7 latching section
7.1 teeth
8 recess
9 latching element
9.1 teeth
10 door lock
11 handle
12 actuating area
D axis of rotation

The invention claimed is:

1. A door lock comprising:

a locking element for locking the door in a closed state, the locking element including a locking tongue configured to be rotated by a door handle of the door about an axis of rotation extending perpendicular to an outer surface of the door; and a fastening element for fastening the locking element to the door, the fastening element is an annular ring configured to be seated on the locking element and on the outer surface of the door with the axis of rotation extending through a radial center of the annular ring;

wherein the fastening element has an adjustable adjustment device to compensate for different door thicknesses;

wherein the adjustment device has at least one ramp section having a slope, which ramp section interacts with a latching element of the locking element when the fastening element is rotated about the axis of rotation against the outer surface of the door from an assembly position to a latching position, in the latching position the adjustment device is secured between the latching element and the outer surface of the door; and wherein the latching element projects from an outer circumference of the locking element, the outer circumference is a bearing element for the fastening element during rotation of the fastening element about the axis of rotation from the assembly position to the latching position.

2. The locking device according to claim 1, wherein the fastening element is part of a bayonet fastening.

3. The locking device according to claim 1, wherein the fastening element is pressable onto the door via the adjustment device.

4. The locking device according to claim 3, wherein a contact pressure of the fastening element onto the door is adjustable via the adjustment device.

5. The locking device according to claim 3, wherein a contact pressure can be adjusted by rotating the fastening element relative to the locking element.

6. The locking device according to claim 1, wherein the locking element moves in axial direction relative to the fastening element when the fastening element is rotated.

7. The locking device according to claim 1, wherein the adjustment device has a latching section for fixing the fastening element relative to the locking element.

8. The locking device according to claim 7, wherein the latching section has several latching steps.

9. The locking device according to claim 1, wherein the fastening element has an actuation area via which the fastening element can be rotated.

10. The locking device according to claim 1, in which the degree of slope of the ramp section determine a transmission ratio between the rotation of the fastening element and a change of a contact pressure of the fastening element onto the door.

11. The locking device according to claim 1, in which the ramp section extends in direction of a circular arc.

12. A door with a locking device according to claim 1.

13. A method comprising:

fastening a locking element to a door with a fastening element, wherein the locking element includes a locking tongue configured to be rotated by a door handle of the door about an axis of rotation extending perpendicular to an outer surface of the door, wherein a contact pressure of the fastening element onto the door is adjusted via an adjustment device of the fastening element to compensate for different door thicknesses, in that at least one ramp section of the adjustment device interacts with a latching element of the locking element when the fastening element is rotated about the axis of rotation against the outer surface of the door from an assembly position to a latching position, in the latching position the adjustment device is secured between the latching element and the outer surface of the door;

wherein the fastening element is an annular ring configured to be seated on the locking element and on the outer surface of the door with the axis of rotation extending through a radial center of the annular ring; and wherein the latching element projects from an outer circumference of the locking element, the outer circumference is a bearing element for the fastening element during rotation of the fastening element about the axis of rotation from the assembly position to the latching position.

14. The method according to claim 13, in which the latching element is moved away from the door in axial direction when the fastening element is rotated from the assembly position into the latching position.

15. The method according to claim 13, in which the latching element slides along a ramp section of the adjustment device when the fastening element is rotated.

16. A door lock comprising:

a locking element for locking the door in a closed state, the locking element including:

a locking tongue configured to be rotated by a door handle of the door about an axis of rotation extending perpendicular to an outer surface of the door; a bearing element aligned along the axis of rotation; and a latching element extending outward from an outer circumference of the bearing element; and a fastening element for fastening the locking element to the door, the fastening element is an annular ring configured to be seated on the bearing element and on the outer surface of the door with the axis of rotation extending through a radial center of the annular ring, the fastening element including:

an adjustment device that is adjustable to compensate for different door thicknesses, the adjustment device including at least one ramped surface that cooperates with the latching element of the locking element when the fastening element is rotated about the axis of rotation against the outer surface of the door from an assembly position to a latching position, in the latching position the adjustment device is secured between the latching element and the outer surface of the door;

wherein:

the bearing element is a bearing for the fastening element during rotation of the fastening element from the assembly position to the latching position;

the locking element and the fastening element cooperate as a bayonet lock; and the fastening element is annular.

* * * * *